US009711908B2

(12) United States Patent
Yao et al.

(10) Patent No.: US 9,711,908 B2
(45) Date of Patent: Jul. 18, 2017

(54) ELECTRICAL CONNECTOR HAVING IMPROVED TERMINALS

(71) Applicant: FOXCONN INTERCONNECT TECHNOLOGY LIMITED, Grand Cayman (KY)

(72) Inventors: Tao Yao, Huaian (CN); Jing-Jie Guo, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/236,656

(22) Filed: Aug. 15, 2016

(65) Prior Publication Data

US 2017/0047687 A1 Feb. 16, 2017

(30) Foreign Application Priority Data

Aug. 13, 2015 (CN) ..... 2015 1 0494982

(51) Int. Cl.

| | |
|---|---|
| ***H01R 24/00*** | (2011.01) |
| ***H01R 13/6471*** | (2011.01) |
| ***H01R 13/6581*** | (2011.01) |
| ***H01R 24/64*** | (2011.01) |
| *H01R 107/00* | (2006.01) |

(52) U.S. Cl.
CPC ..... *H01R 13/6471* (2013.01); *H01R 13/6581* (2013.01); *H01R 24/64* (2013.01); *H01R 2107/00* (2013.01)

(58) Field of Classification Search
CPC ..... H01R 23/02; H01R 24/60; H01R 24/62
USPC ..... 439/660
See application file for complete search history.

(56) References Cited

U.S. PATENT DOCUMENTS

| | | | | |
|---|---|---|---|---|
| 4,582,386 | A * | 4/1986 | Martens | H01R 12/727 439/101 |
| 6,540,559 | B1 * | 4/2003 | Kemmick | H01R 23/688 439/108 |
| 6,945,796 | B2 * | 9/2005 | Bassler | H01R 12/724 439/101 |
| 8,864,501 | B2 * | 10/2014 | Lin | H01R 13/65807 439/607.4 |
| 2015/0140866 | A1 | 5/2015 | Tsai et al. | |

(Continued)

FOREIGN PATENT DOCUMENTS

| | | |
|---|---|---|
| CN | 201178205 | 1/2009 |
| CN | 201725893 | 1/2011 |
| CN | 104009308 | 8/2014 |

(Continued)

*Primary Examiner* — Phuong Dinh
(74) *Attorney, Agent, or Firm* — Wei Te Chung; Ming Chieh Chang

(57) ABSTRACT

An electrical connector, defining an insertion port, a mating direction, a transverse direction perpendicular to the mating direction, and a vertical direction perpendicular to the mating direction and the transverse direction, includes an insulative housing, a number of terminals retained in the insulative housing, and a metal shell attached to the insulative housing. Each terminal has a soldering portion. The terminals have a number of grounding contacts, power contacts, and signal contacts. A maximum width of the power contact and the grounding contact is larger than that of the signal contact along the transverse direction.

2 Claims, 8 Drawing Sheets

(56) References Cited

U.S. PATENT DOCUMENTS

| | | | |
|---|---|---|---|
| 2015/0333460 | A1 | 11/2015 | Regnier et al. |
| 2016/0118750 | A1 | 4/2016 | Guo et al. |

FOREIGN PATENT DOCUMENTS

| | | |
|---|---|---|
| CN | 203859323 | 10/2014 |
| CN | 204216260 | 3/2015 |
| CN | 204243365 | 4/2015 |
| CN | 204391333 | 6/2015 |
| CN | 204424511 | 6/2015 |
| CN | 104810689 | 7/2015 |
| CN | 204481257 | 7/2015 |
| TW | 499669 | 4/2015 |
| TW | M499696 | 4/2015 |
| WO | 2015181625 | 12/2015 |
| WO | 2015181629 | 12/2015 |

* cited by examiner

ELECTRICAL CONNECTOR HAVING IMPROVED TERMINALS

BACKGROUND OF THE INVENTION

1. Field of the Invention

The present invention relates to an electrical connector having improved terminals.

2. Description of Related Art

Universal Serial Bus (USB) and USB connectors are well known in the art. Taiwan Patent No. M499669 discloses a reversible electrical connector. The electrical connector includes a number of signal contacts having a contacting portion, a soldering portion, and a connecting portion connected with the contacting portion and the soldering portion. A width of the connecting portions is different from a width of the contacting portions so that impedance of the signal contacts is available to adjust to attain a good high frequency. However, the resistance value of the electrical connector fails to meet the requirement of the heavy current passing through.

An improved electrical connector is desired.

SUMMARY OF THE INVENTION

Accordingly, the object of the present invention is to provide an electrical connector, defining an insertion port, a mating direction, a transverse direction perpendicular to the mating direction, and a vertical direction perpendicular to the mating direction and the transverse direction, comprising: an insulative housing; a plurality of terminals retained in the insulative housing, each terminal having a soldering portion, the terminals having a plurality of grounding contacts, power contacts, and signal contacts, a maximum width of the power contact and the grounding contact being larger than that of the signal contact along the transverse direction; and a metal shell attached to the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
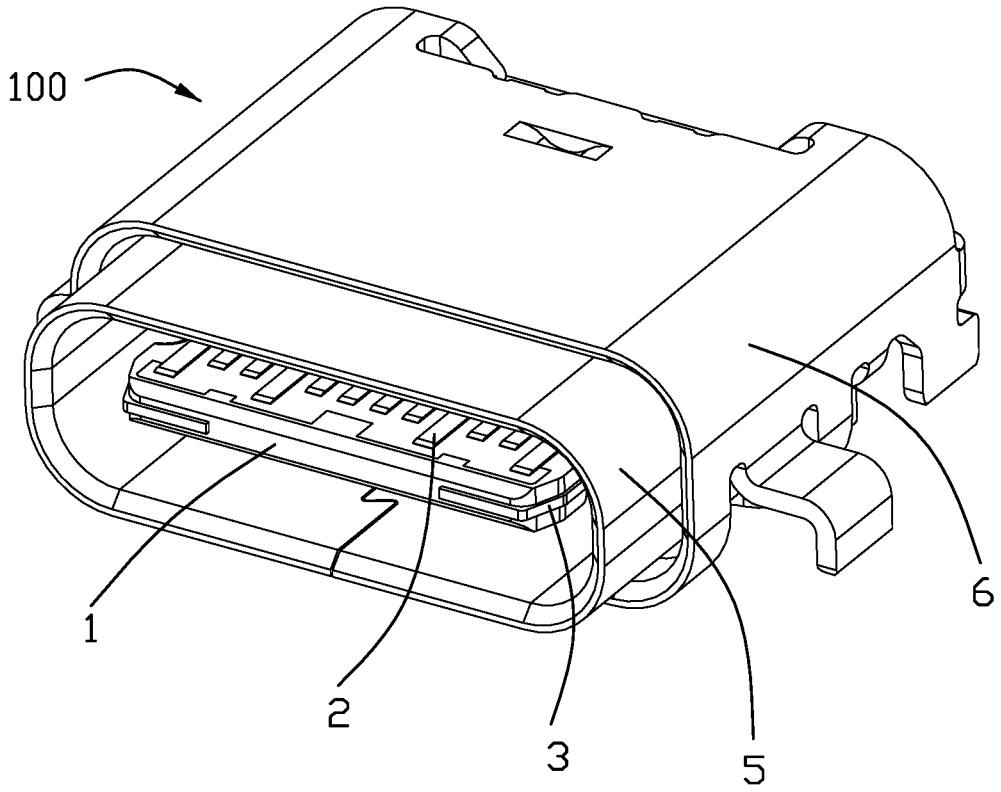
FIG. 1 is a perspective, assembled view of an electrical connector.
Figure 2:
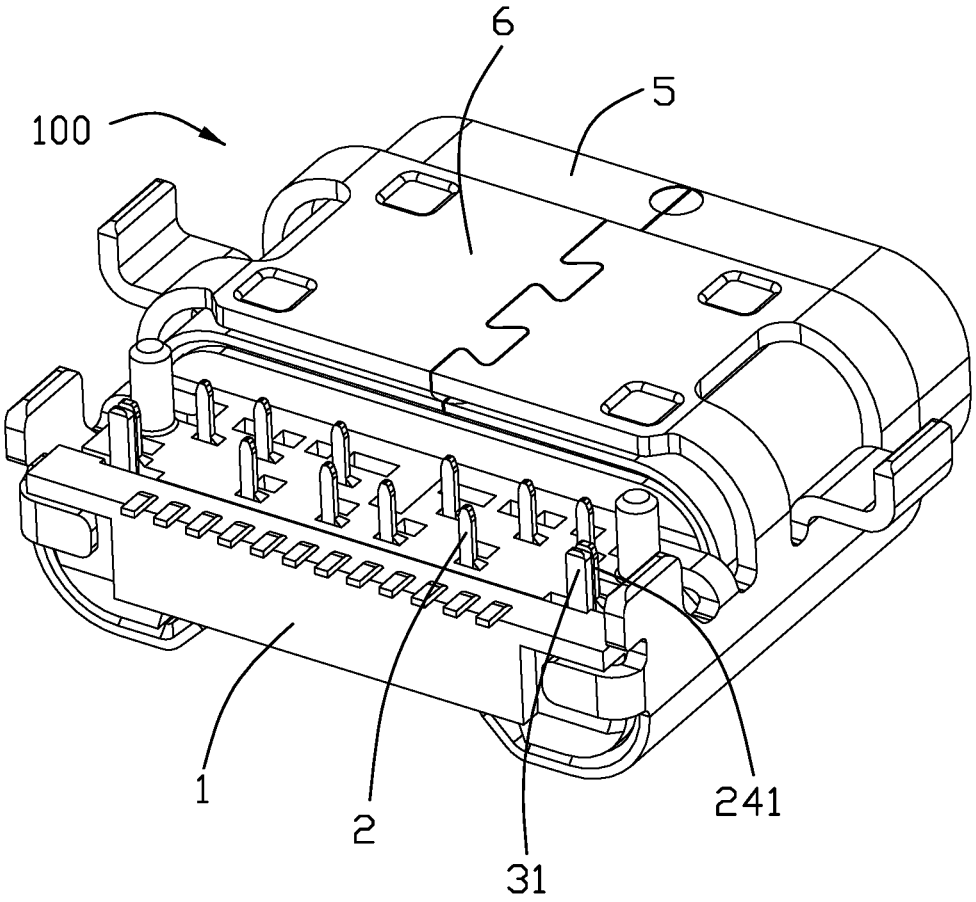
FIG. 2 is another perspective, assembled view of FIG. 1.

Reference will now be made in detail to the preferred embodiment of the present invention.

FIGS. 1 to 8 show an electrical connector 100 cooperated with a plug connector. For convenience, the electronic connector 100 defines a mating port, a mating direction, a transverse direction perpendicular to the mating direction and forming a horizontal plane therebetween, and a vertical direction perpendicular to the mating direction and the transverse direction in FIG. 1.

The electrical connector 100 includes an insulative housing 1, a number of terminals 2 and a metallic shielding plate 3 retained in the insulative housing 1, a pair of collar shell 4 affixed to the insulative housing 1, a shielding shell 5 attached to the insulative housing 1, and a metal shell 6 affixed to the shielding shell 5.

Figure 3:
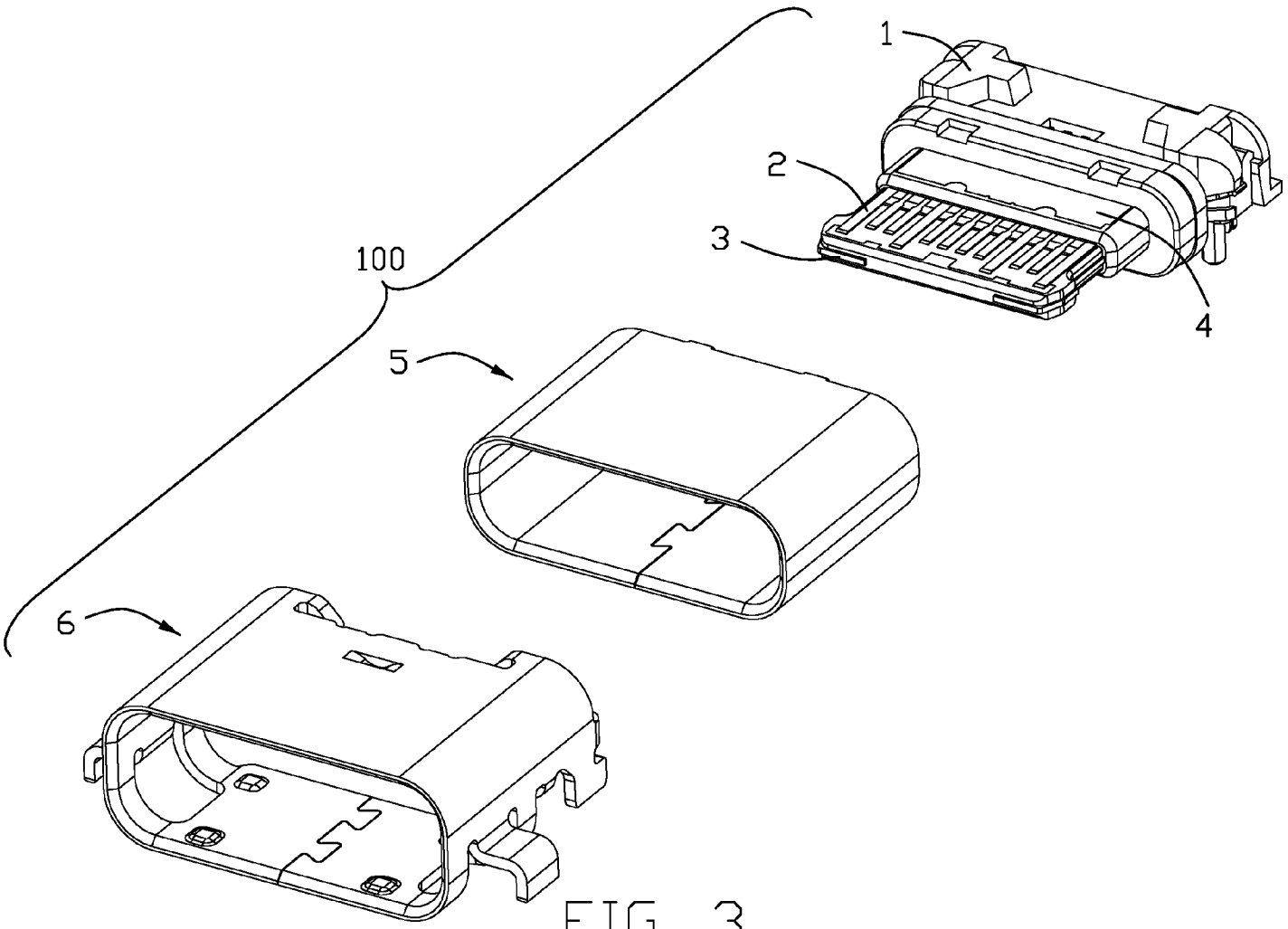
FIG. 3 is a perspective, partly exploded view of the electrical connector.
Figure 4:
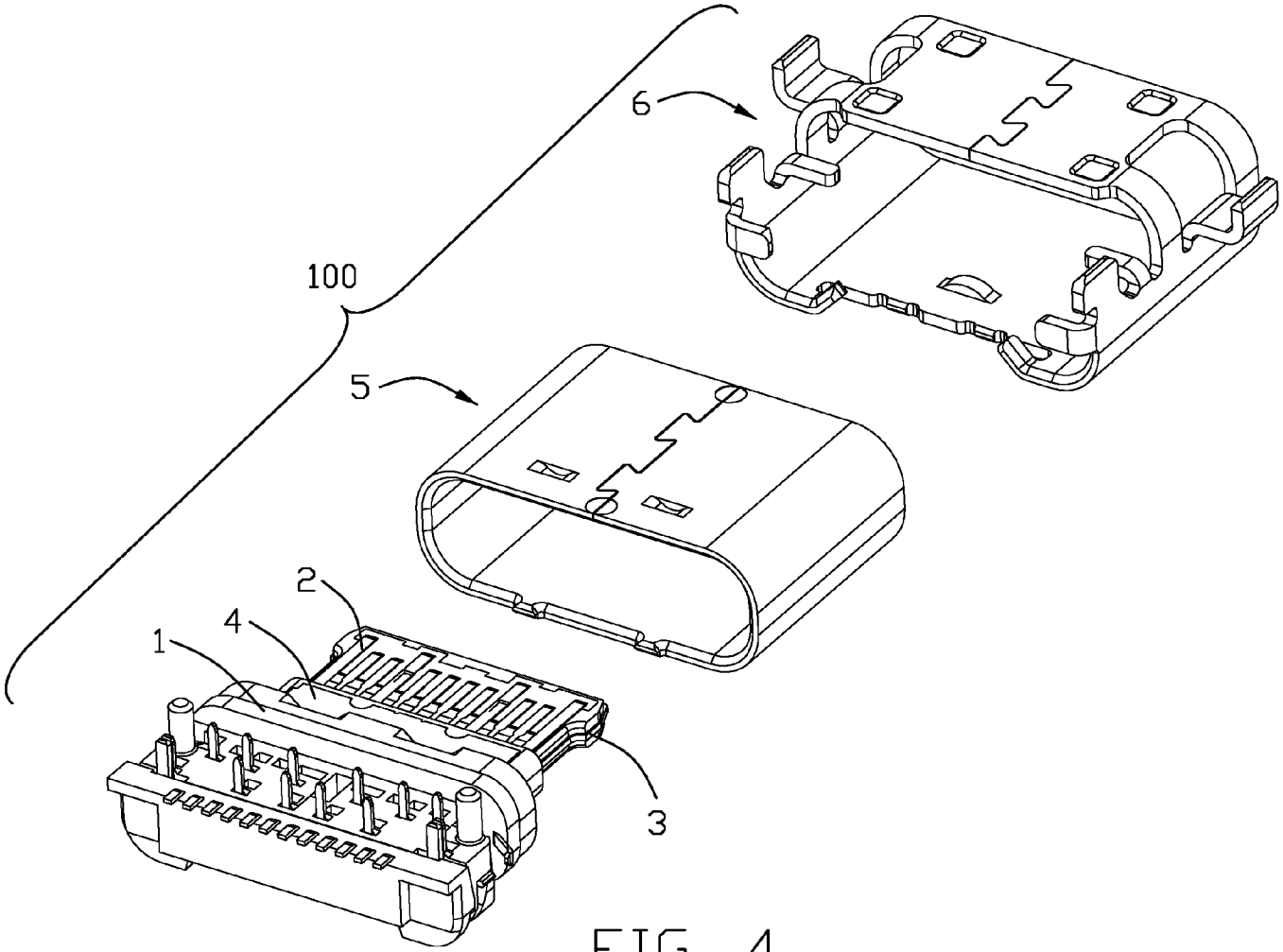
FIG. 4 is another perspective, partly exploded view of FIG. 3.
Figure 5:
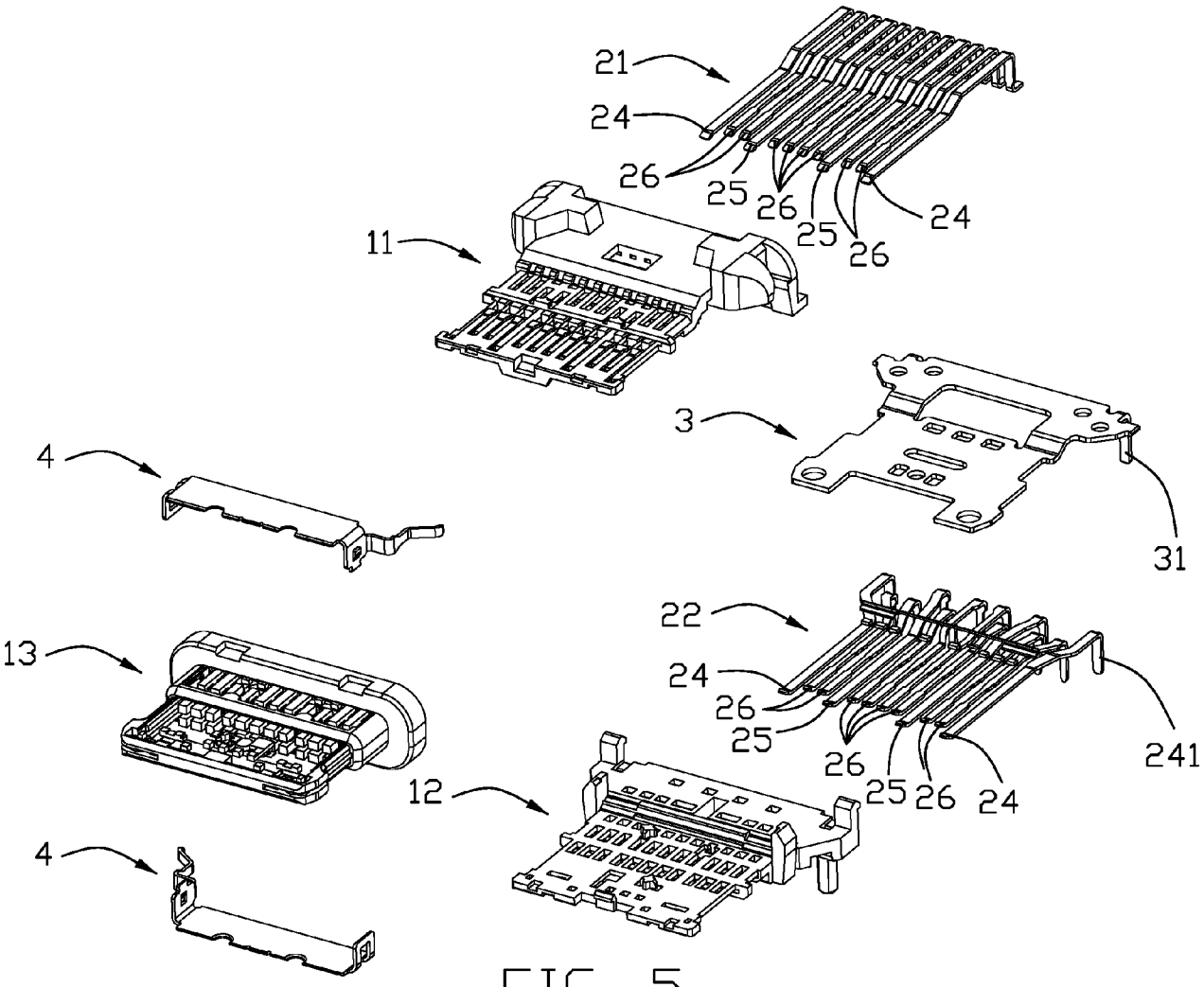
FIG. 5 is a perspective, exploded view of the electrical connector with no shielding shell and no metal shell.
Figure 6:
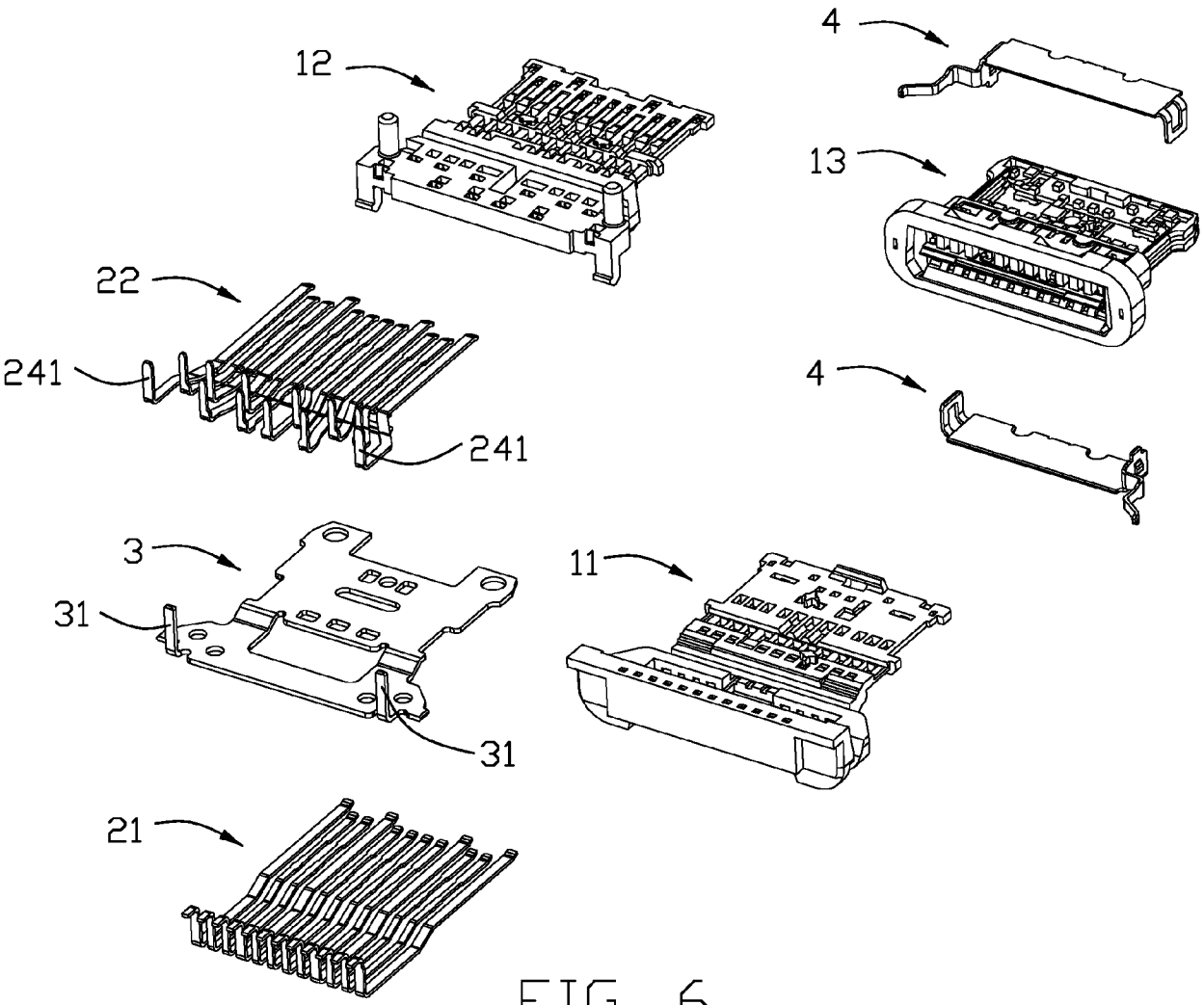
FIG. 6 is another perspective, exploded view of FIG. 5.
Figure 7:
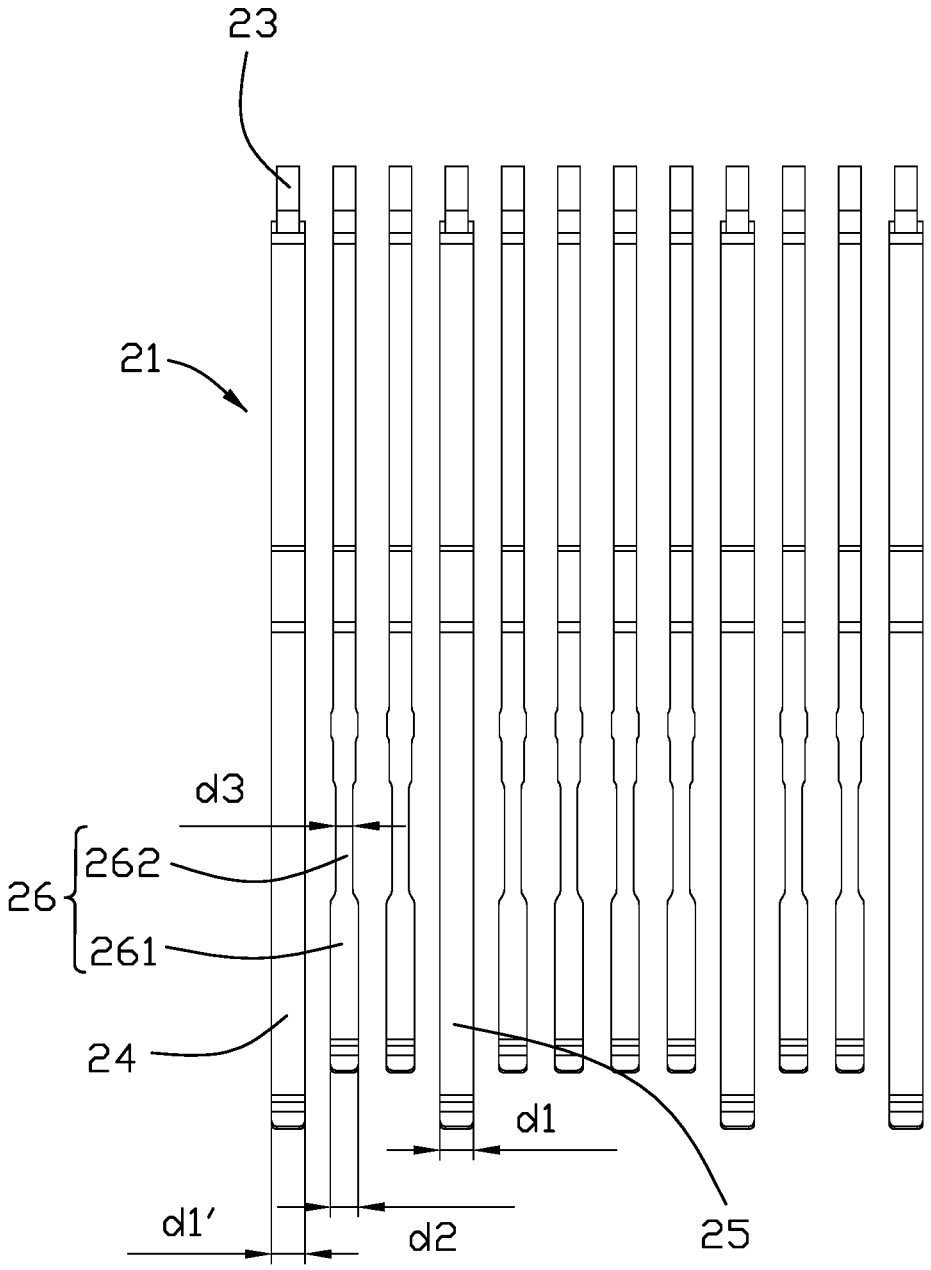
FIG. 7 is a top view of a number of first contacts.
Figure 8:
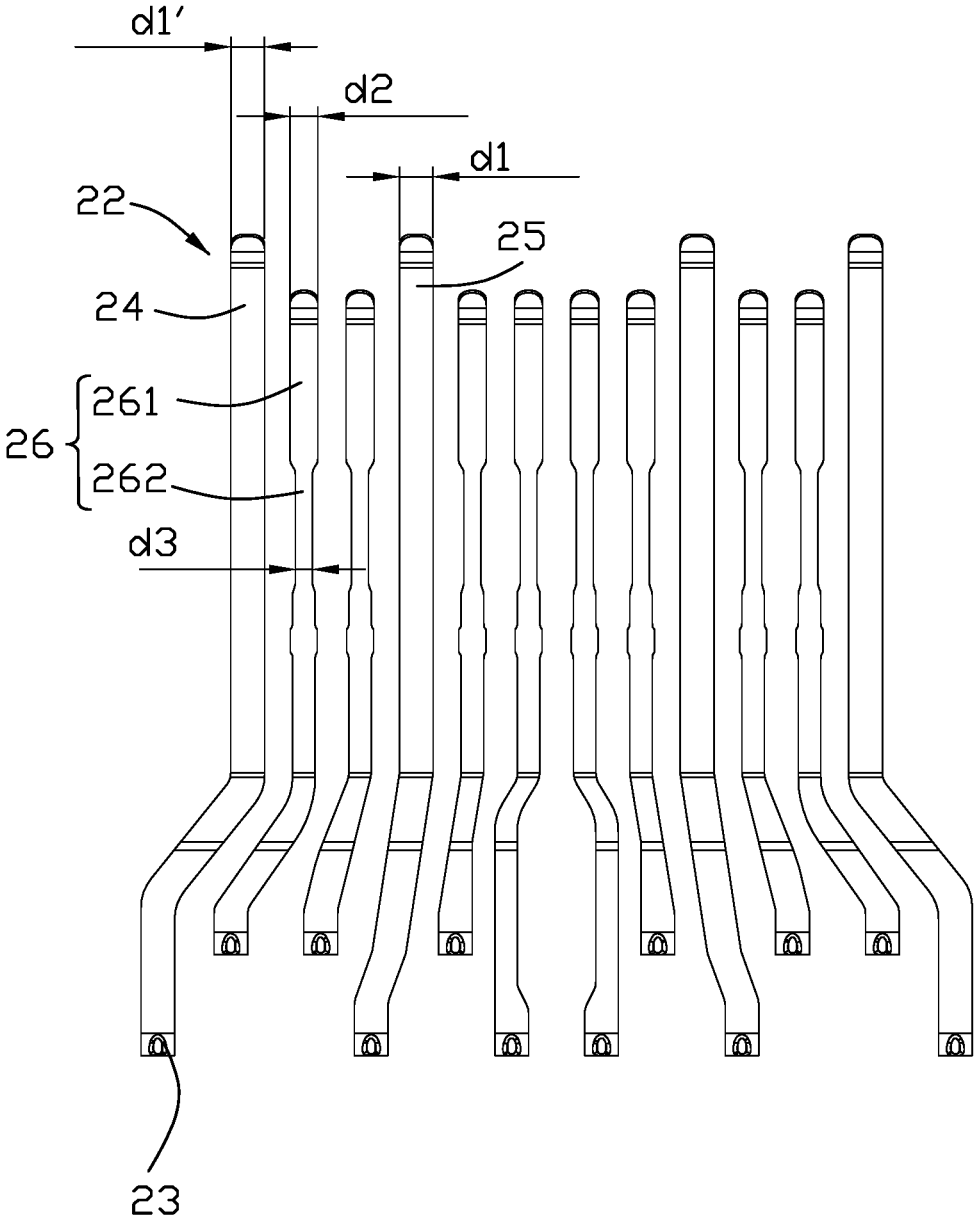
FIG. 8 is a bottom view of a number of second contacts.

Referring to FIGS. 3 to 4, the insulative housing 1 includes an upper insulative body 11, a lower insulative body 12, and a third insulative body 13 over-molded with the upper insulative body 11 and the lower insulative body 12.

Referring to FIGS. 3 to 6, the terminals 2 include a number of first contacts 21 carried by the upper insulative body 11 and a number of second contacts 22 carried by the lower insulative body 12. Each of the terminals 2 includes a soldering portion 23 soldered on a printed circuit board (not figured) via SMT or through hole. The first contacts 21 and the second contacts 22 are positioned to have 180 degree symmetry such that the corresponding plug connector can be inserted and operatively coupled to the electrical connector 100 in either of two orientations. Each of the first contacts 21 is associated with a respective one of the second contacts 22 and is positioned in reverse symmetry with respect to the second contacts 22.

The first contacts 21 and the second contacts 22 extend in the mating direction and respectively include a pair of grounding contacts 24, a pair of power contacts 25 located forwardly and eight signal contacts 26 located backwardly. The pair of power contacts 25 in the middle is used to provide electric source and the pair of grounding contacts 24 located at two sides of the signal contacts 26 is used for electrical grounding. The eight signal contacts 26 include four super-speed differential contacts located at two sides, two low-speed differential contacts located in the middle, and a pair of controlling contacts. Each power contact 25 defines a first maximum width d1 larger than a second maximum width d2 defined in each signal contact 26 along the transverse direction to attain a larger resistance value to meet the requirement of passing through heavy current and guarantee stable signal transmission. Each grounding contact 24 defines a third maximum width d' larger than the second maximum width d2 of the signal contacts 26 along the transverse direction to attain a larger resistance value to meet the requirement of passing through heavy current and guarantee grounding. The grounding contacts 24 and the power contacts 25 respectively have a same width except the soldering portion 23. Each signal contact 26 defines a contacting portion 261 and a connecting portion 262 extending backwardly from the contacting portion 261. In a preferred embodiment, a width of a part of the grounding contacts 24 exposed from the insulative housing 1 is as large as that of a part of the power contacts 25 exposed from the insulative housing 1, in other word, d1'=d1. The connecting portions 262 of the signal contacts define a fourth maximum width d3 along the transverse direction smaller than the second maximum width d2 defined in the contacting portions 261 of the signal contacts 26 along the transverse direction to ensure the contacting portions 261 stable and increase a width between the signal contacts 26 and the grounding contacts 24 with the power contacts 25 along the transverse direction to avoid wrong contact. The connecting portion of the signal contact is narrower than the connecting portion of the power contact and the grounding contact. The contacting portion 261 of the signal contact 26 is wider narrower than a contacting portion of the power contact 25 and the grounding contact 24. A distance between the connecting portion 262 of the signal contact and the connecting portion of the adjacent power contact 25 is larger than that between the contacting portion 261 of the of the signal contact 26 and the connecting portion of said adjacent power contact 25. A distance between the connecting portion 262 of the signal contact 26 and the connecting portion of the adjacent the grounding contact 24 is larger than that between the contacting portion 261 of the of the signal contact 26 and the connecting portion of said adjacent the grounding contact 25.

Referring to FIGS. 3 to 4, the grounding contacts 24 have a number of grounding legs 241 and the metallic shielding plate 3 has a pair of soldering legs 31 close to the grounding legs. The grounding legs 241 and the soldering legs 31 in a same side are received in a same hole of the printed circuit board.

Referring to FIGS. 1 to 4, the shielding shell 4 is located in the metal shell 5 and a front end thereof is exposed from the metal shell 5.

However, the disclosure is illustrative only, changes may be made in detail, especially in matter of shape, size, and arrangement of sections within the principles of the invention.

What is claimed is:

1. An electrical connector, defining an insertion port, a mating direction, a transverse direction perpendicular to the mating direction, and a vertical direction perpendicular to the mating direction and the transverse direction, comprising:

an insulative housing;

a plurality of terminals retained in the insulative housing, each terminal having a contacting portion, a soldering portion and a connecting portion between the contacting portion and the soldering portion, the terminals having a plurality of grounding contacts, power contacts, and signal contacts, a maximum width of the power contact and the grounding contact being larger than that of the signal contact along the transverse direction; and a metal shell attached to the insulative housing;

wherein a width of each power contact is invariable except at the soldering portion and a width of each grounding contact is invariable except at the soldering portion;

wherein each grounding contact defines a first maximum width of a part exposed upon the insulative housing, each power contact defines a second maximum width of a part exposed upon the insulative housing, and said first maximum width is roughly equal to said second maximum width;

wherein a width of the contacting portion of the signal contact is larger than that of the connecting portion of the signal contact;

wherein the connecting portion of the signal contact is narrower than those of the power contact and the grounding contact;

wherein the contacting portion of the signal contact is narrower than those of the power contact and the grounding contact;

wherein a distance between the connecting portion of the signal contact and the connecting portion of the adjacent power contact is larger than that between the contacting portion of the signal contact and the contacting portion of said adjacent power contact.

2. An electrical connector, defining an insertion port, a mating direction, a transverse direction perpendicular to the mating direction, and a vertical direction perpendicular to the mating direction and the transverse direction, comprising:

an insulative housing;

a plurality of terminals retained in the insulative housing, each terminal having a contacting portion, a soldering portion and a connecting portion between the contacting portion and the soldering portion, the terminals having a plurality of grounding contacts, power contacts, and signal contacts, a maximum width of the power contact and the grounding contact being larger than that of the signal contact along the transverse direction; and a metal shell attached to the insulative housing;

wherein a width of each power contact is invariable except at the soldering portion and a width of each grounding contact is invariable except at the soldering portion;

wherein each grounding contact defines a first maximum width of a part exposed upon the insulative housing, each power contact defines a second maximum width of a part exposed upon the insulative housing, and said first maximum width is roughly equal to said second maximum width;

wherein a width of the contacting portion of the signal contact is larger than that of the connecting portion of the signal contact;

wherein the connecting portion of the signal contact is narrower than those of the power contact and the grounding contact;

wherein the contacting portion of the signal contact is narrower than those of the power contact and the grounding contact;

wherein a distance between the connecting portion of the signal contact and the connecting portion of the adjacent grounding contact is larger than that between the contacting portion of the signal contact and the contacting portion of said adjacent grounding contact.

* * * * *